US005386980A

United States Patent [19]

Mahoney

[11] Patent Number: 5,386,980

[45] Date of Patent: Feb. 7, 1995

[54] IMAGE FORMING APPARATUS AND SHEET INVERTER PROVIDING INCREASED SHEET BEAM STRENGTH

[75] Inventor: Gregory P. Mahoney, Fairport, N.Y.

[73] Assignee: Eastman Kodak Company, Rochester, N.Y.

[21] Appl. No.: 213,642

[22] Filed: Mar. 16, 1994

[51] Int. Cl.[6] ..... B65H 85/00; B65H 29/00

[52] U.S. Cl. ..... 271/3; 271/186; 271/161; 271/209; 355/319

[58] Field of Search ..... 271/3, 291, 186, 209, 271/161, 902; 355/318, 319

[56] References Cited

U.S. PATENT DOCUMENTS

| | | | |
|---|---|---|---|
| 2,827,288 | 3/1958 | Geislor | 271/161 |
| 4,054,285 | 10/1977 | Stange et al. | 271/186 |
| 4,078,789 | 3/1978 | Kittredge et al. | 271/65 |
| 4,986,529 | 1/1991 | Agarwal et al. | 271/291 |
| 5,082,272 | 1/1992 | Xydias et al. | 271/186 |
| 5,133,541 | 7/1992 | Sadanobu et al. | 271/186 |
| 5,166,738 | 11/1992 | Tani | 355/319 |
| 5,265,864 | 11/1993 | Roux et al. | 271/186 |

OTHER PUBLICATIONS

Research Disclosure, Nov. 1991, p. 898, Item No. 33186, Sheet Inverting Apparatus.

*Primary Examiner*—H. Grant Skaggs
*Attorney, Agent, or Firm*—Leonard W. Treash

[57] ABSTRACT

A sheet inverter generally of the type having a chute for receiving a moving sheet fed in through an input nip and out through an output nip includes an edge engaging stop which is resilient or movable to push the sheet into the output nip. The chute is defined by a pair of paper guides that are curved at one end to bend the leading edge of the sheet into a crosstrack curve that improves its beam strength while the trailing edge is not curved in the crosstrack direction, allowing it to be easily fed into the output nip.

5 Claims, 2 Drawing Sheets

IMAGE FORMING APPARATUS AND SHEET INVERTER PROVIDING INCREASED SHEET BEAM STRENGTH

This invention relates to a sheet inverter particularly usable in an image forming apparatus. For example, it relates to a sheet inverter particularly usable in a duplex path of an image forming apparatus.

U.S. patent application Ser. No. 08/148,477, filed Nov. 8, 1993, to Russel et al, shows an image forming apparatus having a finite length duplex return path. A sheet inverter is located along the path into which a receiving sheet can be fed or not fed depending on the desired orientation of the receiving sheet downstream of the inverter. To efficiently handle various intrack lengths of receiving sheet, the inverter is designed to variably delay the sheet. It is a three roller inverter having a chute with an end stop that can be positioned according to the intrack length of the sheet. The stop is moved against the initial direction of the sheet to push the sheet into an output nip formed by two of the three rollers. This inverter has great advantage in its ability to provide a variable delay and simplify efficient production of duplex copies with a finite return path and variable length sheets.

Three roller inverters are well known, per se. The November 1991 publication of Research Disclosure, page 898, item 33186 shows a three roller inverter without a delay, in which an embossment in a sheet entrance guide plate near the input nip creases the receiving sheet to increase the beam strength of the sheet in the intrack direction. That is, a bend extending the length of a sheet makes the sheet resist bending across the sheet. This increased beam strength allows a flimsy receiving sheet to be pushed laterally by the center roller into the output nip when the opposite edge of the sheet is pushed by a resilient stop. However, feeding of the sheet into the output nip is more reliably accomplished if the edge being fed into the output nip is, in fact, straight. In this prior apparatus, the edge entering the output nip straightens when it leaves the embossment before it enters the output nip.

Other references showing three and four roller inverters include U.S. Pat. No. 5,082,272, granted to Xydias et al Jan. 21, 1992; U.S. Pat. No. 4,986,529 to Agarwaal et al, granted Jan. 22, 1991; and U.S. Pat. No. 4,078,789 to Kitteridge.

U.S. Pat. No. 5,166,738 to Tani, granted Nov. 24, 1992; shows a resilient stop at the end of an inversion chute which is attached to a belt for movement by a motor to adjust the position of the stop for varying sizes.

SUMMARY OF THE INVENTION

It is an object of the invention to provide a sheet inverter generally of the type having a chute for receiving a receiving sheet, an input means for feeding a receiving sheet into the chute, an output means adjacent the input means for feeding a receiving sheet out of the chute, an edge engaging means for engaging the leading edge of the receiving sheet in the chute after or as it leaves the input means and for pushing the sheet into the output means, which sheet inverter is capable of handling fairly lightweight sheets that ordinarily would have relatively low beam strength.

This and other objects are accomplished by a chute that is shaped to bend the leading edge of the sheet into a crosstrack curve as it contacts the edge engaging means, while the trailing edge remains straight.

According to a preferred embodiment, the chute is defined by a pair of paper guides which define a separation which is generally straight at its entrance but has a gradually increasing crosstrack curvature toward the edge engaging means. The gradually increasing crosstrack curvature adds beam strength to the receiving sheet where it is being engaged by the edge engaging means to facilitate pushing the sheet back toward the output means. No curvature is imparted to the edge of the sheet that enters the output means which is kept straight by the entrance. It, thus, provides reliability both in the engaging of the sheet by the edge engaging means and in the presentation of a straight edge to the output means.

SPECIFIC DESCRIPTION OF THE DRAWINGS

DESCRIPTION OF THE PREFERRED EMBODIMENTS

Figure 1:
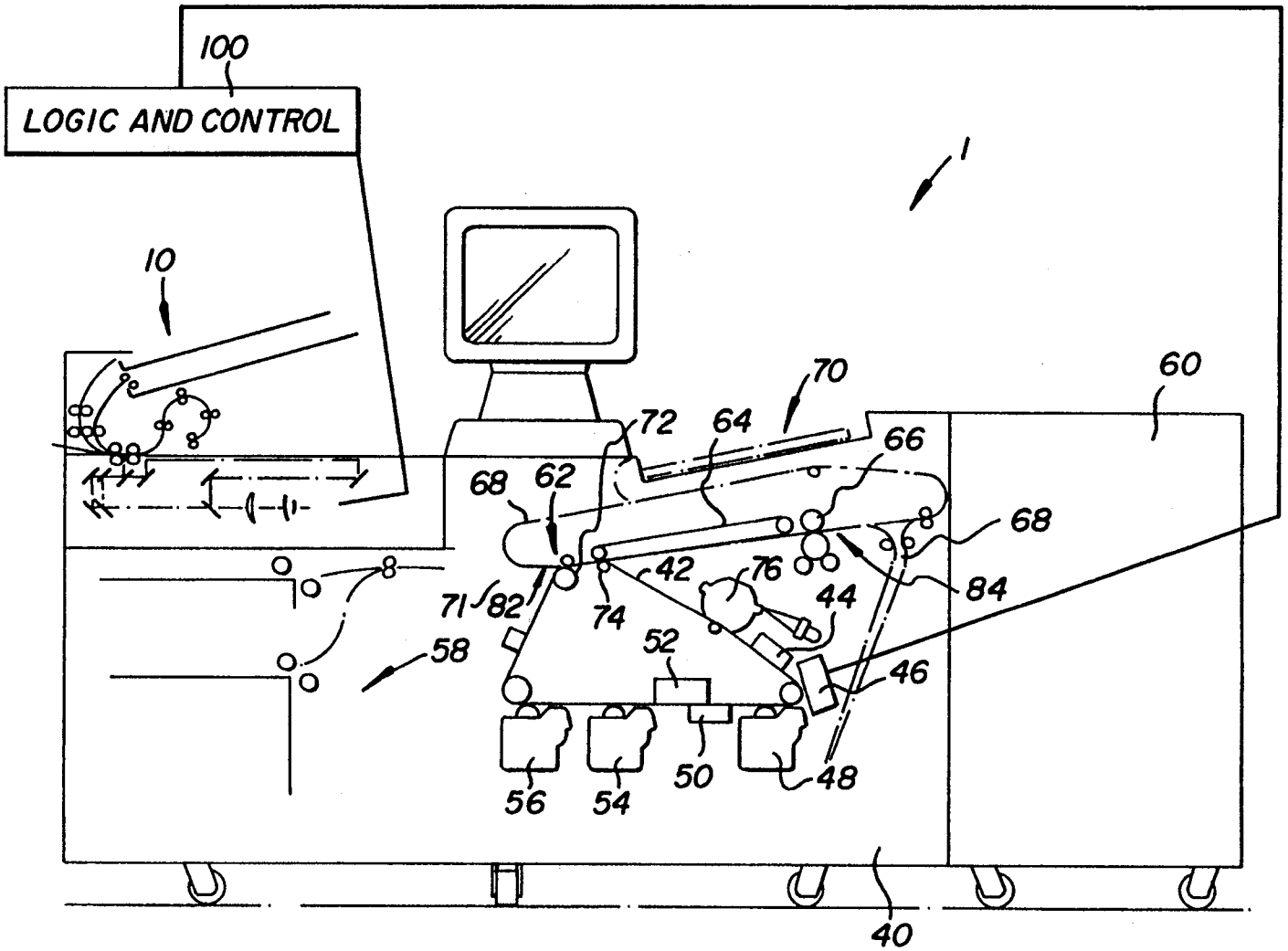
FIG. 1 is a side schematic of an image forming apparatus.

Referring to FIG. 1, an image forming apparatus 1 includes a marking engine 40, an accessory module 60, a paper supply 58 and a document scanner 10. In operation, the scanner 10 includes a document feeder which presents a series of document sheets to an exposure position. As the sheets pass the exposure position, they are electronically scanned for conversion of optical information into an electronic signal.

The marking engine 40 can use any suitable image forming technology, for example, inkjet or thermal. However, as shown in FIG. 1, electrophotographic image forming means is preferred. The image forming means includes an image member, for example, a photoconductive belt 42 which is trained around a series of rollers for movement past a series of stations well known in the electrophotographic art. More specifically, belt 42 passes a charging station 44 where a uniform charge is placed on the belt. The charted belt is imagewise exposed at an electronic exposure station, for example, an LED printhead 46, which is controlled by a logic and control 100 using information obtained from scanner 10. This exposure creates an electrostatic image, which is developed at a developing or toning station 48 by the application of fine dry toner to create a toner image corresponding to the electrostatic image. In a printer mode, printhead 46 can also receive image information from a computer, an image storage media, or the like, not shown.

This process can be repeated with a second color to form a two color image using charging station 50, exposure station 52 and either of toning stations 54 and 56.

The one or two color image is moved on to a transfer station 62. At the same time, a receiving sheet is fed out of paper supply 58 and into a paper path that brings it past the image forming means. The receiving sheet moves into overlying relation with the toner image at the transfer station 62. Transfer of the toner image to the receiving sheet is accomplished by an electrostatic field which can be created by biasing a transfer backing roller 72 or by a transfer corona, both of which are well known in the art. The receiving sheet is separated from belt 42, as belt 42 goes around a small roller 74. The belt is cleaned at a cleaning station 76 for continuous use.

The receiving sheet is transported by a suitable sheet transport device 64 to a fuser 66. The toner image is fused to the receiving sheet by fuser 66 and exits the fuser. Thus far the receiving sheet is moved along a feed path from a first position 82 to a second position 84, exiting the fuser at a relatively constant speed determined by the speed of the image member 42. After it exits the fuser, the receiving sheet can be handled according to several options. It can be fed into accessory model 60 where it could be stapled, stacked, bound, or otherwise further finished. It can be transferred to an upper output hopper 70 where it is stacked in a single stack for the operator. It can also be returned to transfer station 62 through a recirculating path to receive another image on either side. One reason for transferring another image to the same side of the receiving sheet as the first image would be to add another color to that image. In most instances, a return to the transfer station is to add an image to the opposite side of the receiving sheet from that containing the first image to form a duplex copy. The sheets in output hopper 70 can be stacked either face-up or face-down, depending on the order in which the images are formed.

Obviously, some of these options of handling the receiving sheet involve inverting the receiving sheet a different number of times than others of the options. The entire path just described from transfer station 62 through fuser 66 and back around to transfer station 62 is shown in FIG. 1 as a continuous oblong duplex path or loop 69. This path does not include an intermediate tray and, therefore, it does not naturally provide an ultimate inversion of the copy sheet for doing duplex. That is, if the sheet is continuously fed through path 69 without alteration, it will continually present the same side of the sheet to image member 42 at transfer station 62. Thus, to do duplex, an inverter 68 is required. As is known in the art, inverter 68 is conveniently positioned between the fuser 66 and accessory module 60. This allows the use of the inverter to change the orientation of the receiving sheet as part of virtually all options available to the receiving sheet. That is, the receiving sheet can be inverted or not inverted before entering the accessory module, before entering the upper output hopper 70 or before being recirculated back to transfer station 62 to receive an additional image.

Finite recirculating duplex paths, such as that shown at 69 in FIG. 1, are well known in the art. They do not include an intermediate tray, whose absence eliminates a source of problems known to intermediate trays. However, because they are generally of relatively invariable finite length, they create their own set of design challenges. The receiving sheet that receives an image on the first side and is recirculated back to receive an image on the second side must arrive at the transfer station 62 at a relatively exact time to properly position the second image on the sheet. This requires synchronization, for example, between the movement of the receiving sheet through path 69 and the placement of the image on image member 42 by LED printhead 46.

This timing is exacerbated by the desire of modem copiers and printers to handle a large variety of sizes of sheet. If path 69 is of finite length, it is highly desirable, if not essential that the length of the duplex path 69 divided by the pitch of the receiving sheet be an integer. One way this is accomplished in the prior art is to have substantial size dedicated frames that allow the interframe to absorb the differences in intrack dimension (herein sometimes "length") of the receiving sheets. A typical frame pitch could be 18 inches (457 mm), which would accommodate efficiently the long dimension of a ledger sized sheet or the short dimension of two letter sized sheets for each frame. All other sizes would become less efficient, depending on how close in size their intrack dimension is to the ledger or letter sized sheets.

According to the above-cited U.S. patent application to Russel et al, this problem of inefficiency can be solved by varying the effective length of the return path 69. This is accomplished by varying the time which the receiving sheet spends in the inverter 68 according to the length of the receiving sheet. The inverter can be of a three roller type, well known in the art and described above. A stop at the end of a chute receives the sheet in the inverter. Movement of the stop to begin exit of the sheet is delayed to properly lengthen the duplex path for that particular length of sheet. The stop is also adjustable in position according to the length of the sheet.

This invention improves on inverters, both of the type shown in the Russel et al application having a motor driven stop, and of the more conventional type having a resilient stop.

Figure 2:
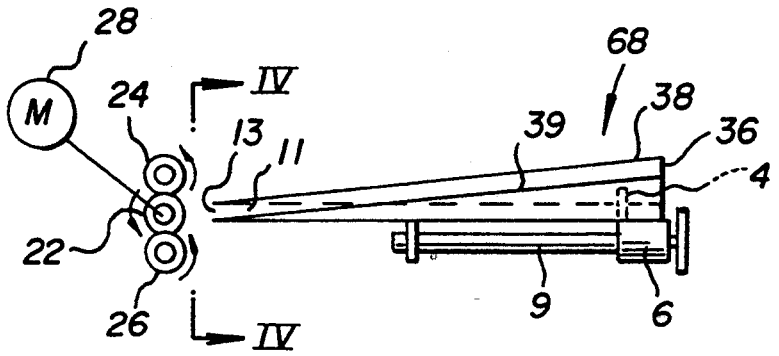
FIGS. 2 and 3 are side and top views of portions of an inverter.
Figure 3:
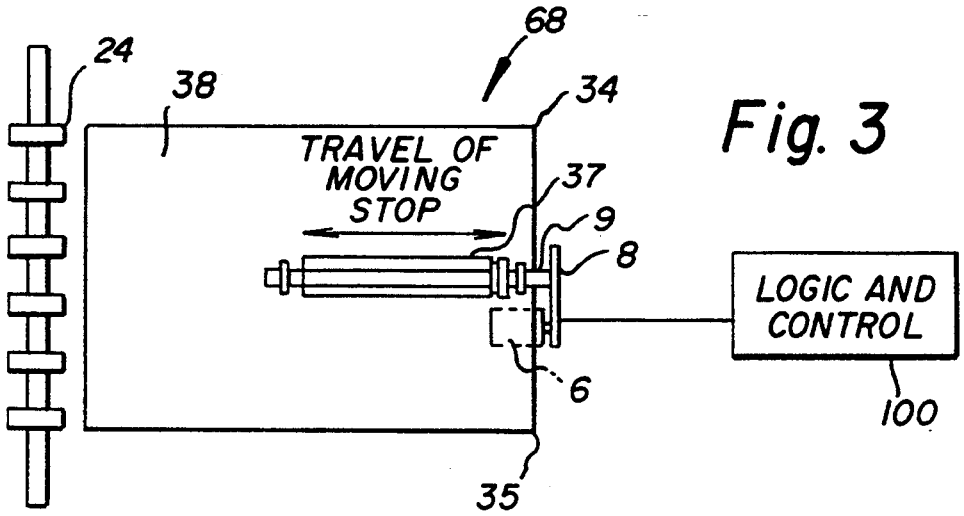
Figure 4:
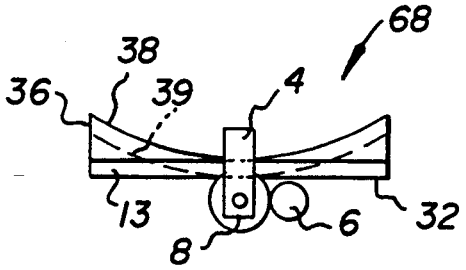
FIG. 4 is a side section from section lines IV in FIG. 2.
Figure 5:
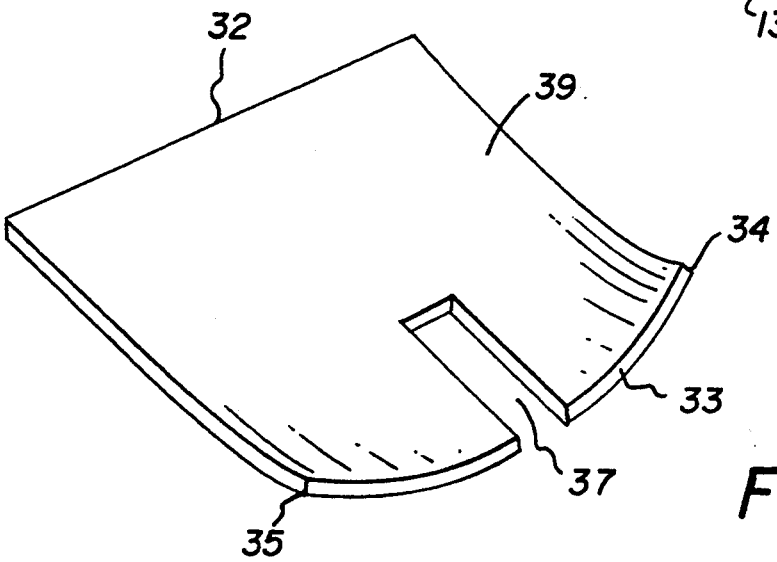
FIG. 5 is a perspective view of a portion of a sheet guide.

Referring to FIGS. 2, 3 and 4, inverter 68 includes a conventional set of three rollers 22, 24 and 26. Roller 22 is a drive roller driven by a motor 28. An input roller 24 frictionally engages drive roller 22 to form an input or entrance nip and an output roller 26 also frictionally engages drive roller 22 to form an output or exit nip. A receiving sheet is fed by suitable guides and rollers (not shown) into the input nip which then drives the sheet further into the inverter. A chute 36 is formed by first and second paper guides 38 and 39, respectively. FIG. 5 is a perspective view of guide 39. Guide 38 is shaped substantially the same as guide 39. More specifically, the guides have an upstream end 32 which is straight in the cross-track direction and a downstream end 33 which is curved in the cross-track direction. Comers 34 and 35 are raised substantially above a plane defined by upstream end 32 and the intrack center portion of the guide.

Slots 37 are cut out of both guides 38 and 39. A movable edge engaging means, for example, a movable vertical stop 4 is positioned to move in slots 37 in paper guides 38 and 39. A stepper motor 6 is positioned to drive a gear 8 on the end of a screw 9 which drives movable stop 4 toward and away from rollers 22, 24 and 26 in response to logic and control 100. The primary purpose in moving stop 4 is to set its distance from roller 22 for different length receiving sheets. However, if a delay is to be provided, as described below, it also can be used to drive the sheet into the output nip.

As shown schematically in FIG. 2, guides 38 and 39 are connected beyond stop 4 and are positioned to define a separation 11 which has an entrance 13 into which a receiving sheet exiting the entrance nip feeds. Other conventional guides between the input nip and the entrance 13 are not shown in the FIGS. As the receiving sheet is fed by rollers 22 and 24 into the separation 11 in chute 36 defined by guides 38 and 39, the leading edge of the receiving sheet is gradually curved according to the shape of the guides 38 and 39. This curvature greatly increases the beam strength in the intrack direction.

If stop 4 is a conventional resilient stop, the sheet is fed into separation 11 with just enough force that the stop 4 compresses to allow the trailing edge of the sheet to be driven by roller 22 toward the exit nip.

If the inverter has a delay, as in the Russel et al structure, stop 4 is positioned so that the trailing edge of the receiving sheet is clear of roller 22 when the leading edge contacts stop 4. The trailing edge moves under gravity toward the exit nip. Logic and control 100 actuates stepper motor 6 to drive stop 4 to the left (as seen in FIGS. 2 and 3) to drive the receiving sheet into the exit nip formed by rollers 22 and 26. Once the leading edge of the receiving sheet is in the nip, stop 4 can be returned to its initial position.

Proper engagement of the trailing edge of the receiving sheet in the exit nip is assisted by its flat condition, as defined by entrance 13. At the same time, movement of a lightweight receiving sheet by stop 4, resilient or motor driven, is assisted by the curvature of the sheet at its leading edge.

The invention has been described in detail with particular reference to a preferred embodiment thereof, but it will be understood that variations and modifications can be effected within the spirit and scope of the invention as described hereinabove and as defined in the appended claims.

I claim:

1. A sheet inverter for inverting a receiving sheet moving in an intrack direction, the receiving sheet having leading and trailing edges, said inverter comprising:

a chute for receiving the receiving sheet, input means for feeding the receiving sheet into the chute, leading edge first, output means adjacent the input means for feeding the receiving sheet out of the chute, trailing edge first, and edge engaging means for engaging the leading edge of the receiving sheet in the chute as or after the sheet leaves the input means, and for pushing the sheet into the output means, characterized in that the chute is shaped to bend the leading edge of the sheet into a crosstrack curve while the trailing edge is not curved.

2. A sheet inverter according to claim 1 wherein the chute includes a first paper guide and a second paper guide sufficiently separated to receive the receiving sheet into a separation between the paper guides, the guides being shaped to further define an entrance to the separation which is straight and to further define the separation with a gradually increasing crosstrack curvature from the entrance toward the edge engaging means.

3. A sheet inverter according to claim 1 wherein the input means and output means comprise a set of three rollers, a middle drive roller, an input roller engaging the drive roller to define an input nip, an output roller engaging the drive roller to define an output nip and means for driving the drive roller.

4. Image forming apparatus comprising:

first means for moving a receiving sheet having a leading edge and a trailing edge along a feed path from a first position to a second position, image forming means adjacent the feed path for forming a first image on a first side of a receiving sheet moving along the feed path, second means for moving a receiving sheet through a recirculating path from the second position back to the first position where the receiving sheet can again be moved through the feed path to receive a second image from the image forming means, means for inverting a receiving sheet after it receives the first image and before it receives the second image, said inverting means including, a chute for receiving a receiving sheet, leading edge first, input means for feeding a receiving sheet into the chute, output means adjacent the input means for feeding a receiving sheet out of the chute, edge engaging means for engaging a leading edge of the receiving sheet in the chute, means for moving the edge engaging means to push the sheet in a reverse direction into operative engagement with the output means, characterized in that the chute is shaped to bend the sheet so that the sheet is curved, in a direction traverse to the reverse direction, at the leading edge when it engages the edge engaging means while its trailing edge is not curved.

5. Image forming apparatus according to claim 4 whereto the input means and output means comprise a set of three rollers, a middle drive roller, an input roller engaging the drive roller to define an input nip, an output roller engaging the drive roller to define an output nip and means for driving the drive roller.

* * * * *